United States Patent [19]

Kannankeril

[11] Patent Number: 4,927,010

[45] Date of Patent: May 22, 1990

[54] SHIPPING BAG FOR CONTAINERS OF POTENTIALLY BIOHAZARDOUS LIQUIDS

[75] Inventor: Charles P. Kannankeril, North Caldwell, N.J.

[73] Assignee: Sealed Air Corporation, Saddle Brook, N.J.

[21] Appl. No.: 290,695

[22] Filed: Dec. 27, 1988

[51] Int. Cl.[5] ..... B65D 81/26

[52] U.S. Cl. ..... 206/204; 206/524.2; 206/524.3

[58] Field of Search ..... 206/204, 205, 207, 210, 206/524, 524.1, 524.3, 524.4, 524.5, 524.8, 521, 523, 591, 594, 524.2

[56] References Cited

U.S. PATENT DOCUMENTS

| | | | |
|---|---|---|---|
| 3,026,209 | 3/1962 | Niblack et al. | 206/204 X |
| 3,084,984 | 4/1963 | Adler | 206/204 X |
| 3,446,208 | 5/1969 | Tomiichi . | |
| 3,460,740 | 8/1969 | Hagen | 206/523 |
| 3,661,680 | 5/1972 | Gore . | |
| 3,888,248 | 6/1975 | Moore et al. . | |
| 3,989,867 | 11/1976 | Sisson . | |
| 3,999,653 | 12/1976 | Haigh et al. | 206/594 X |
| 4,087,002 | 5/1978 | Bambara et al. | 206/523 |
| 4,213,528 | 7/1980 | Kreutz et al. | 206/205 |
| 4,321,997 | 4/1982 | Miller . | |
| 4,382,507 | 5/1983 | Miller . | |
| 4,410,578 | 10/1983 | Miller . | |
| 4,417,894 | 11/1983 | Norris . | |
| 4,519,798 | 5/1985 | Dinius . | |
| 4,573,578 | 3/1986 | Greminger, Jr. et al. | 206/524.4 |
| 4,619,361 | 10/1986 | Thomas, Jr. . | |
| 4,620,633 | 11/1986 | Lookholder | 206/523 |
| 4,679,688 | 7/1987 | Söderhold et al. | 206/204 |
| 4,735,308 | 4/1988 | Barner | 206/204 |
| 4,742,908 | 5/1988 | Thomas, Jr. et al. | 206/204 |

FOREIGN PATENT DOCUMENTS

| | | | |
|---|---|---|---|
| 2452769 | 5/1976 | Fed. Rep. of Germany | 206/210 |
| 1552810 | 9/1979 | United Kingdom | 206/204 |

*Primary Examiner*—Bryon P. Gehman

*Attorney, Agent, or Firm*—Bell, Seltzer, Park and Gibson

[57] ABSTRACT

A shipping bag is disclosed for containers of potentially biohazardous materials wherein the bag has liquid impervious outer panels and pads within the bag to absorb any liquid should the container rupture. In the event of rupture of the container, persons handling such bags will be protected from contact with such liquid by the combined effects of absorbing the liquid and containing the liquid within the fluid impervious outer panels of the bag.

11 Claims, 2 Drawing Sheets

SHIPPING BAG FOR CONTAINERS OF POTENTIALLY BIOHAZARDOUS LIQUIDS

FIELD OF THE INVENTION

This invention relates to a liquid impervious shipping bag for containers of potentially biohazardous liquids which cushions such containers from shocks due to handling and shipping and which absorbs such potentially biohazardous liquid upon rupture of the container to protect persons handling the shipping bag and other packages being shipped from contact with such liquids.

BACKGROUND OF THE INVENTION

It is a common medical practice to collect samples of body fluids from a patient, such as blood, urine and the like, and have them tested at a remote laboratory. Such samples are conventionally placed in sealed containers and the sealed containers are packaged and shipped to the laboratory.

Various types of packaging have been used to ship such body fluid containers, including padded envelopes, corrugated cartons and other conventional packaging. However, despite the use of padded packaging and careful handling such body fluid containers have on frequent occasions become ruptured. The body fluid sample has thereupon soaked through the envelope or other packaging contaminating other packages and posing substantial likelihood of being contacted by persons handling such packages.

With the potential that such liquids may be biohazardous, such as contaminated with the AIDS virus or other infectious disease, the rupturing of such a container places persons handling these and other packages at risk of extremely harmful consequences. In addition, persons to whom the other packages that have been contaminated are addressed frequently will not accept such packages.

Accordingly, it is an object of the present invention to provide a shipping bag for containers of potentially biohazardous liquids which obviates the aforementioned problems and deficiencies of prior packaging.

SUMMARY OF THE INVENTION

The above and other objects of the invention are achieved by a shipping bag which comprises first and second outer panels formed of a liquid impervious material connected along opposed side edges and one end to define an open top liquid impervious body portion. The bag further comprises liquid absorbing means confined within said body portion and comprising a pair of absorbent pads arranged adjacent each of said first and second outer panels, and first and second inner panels formed of a liquid permeable material disposed parallel to said first and second outer panels and respectively connected therewith along opposed sides and opposite ends to define an open inner space in communication with said open top and separating said liquid absorbing means from said inner space. Closure means are provided at the open top of the bag to sealingly close the inner space and retain any liquids.

The shipping bag may also include, as an added feature, a bacteriastatic agent in the absorbent pad to neutralize any biohazardous liquid absorbed into the pad.

BRIEF DESCRIPTION OF THE DRAWINGS

Some of the objects of the invention have been stated and other will appear as the description proceeds when taken in conjunction with the accompanying drawings in which.

DETAILED DESCRIPTION OF THE PREFERRED EMBODIMENT

Figures 1, 2, 3:
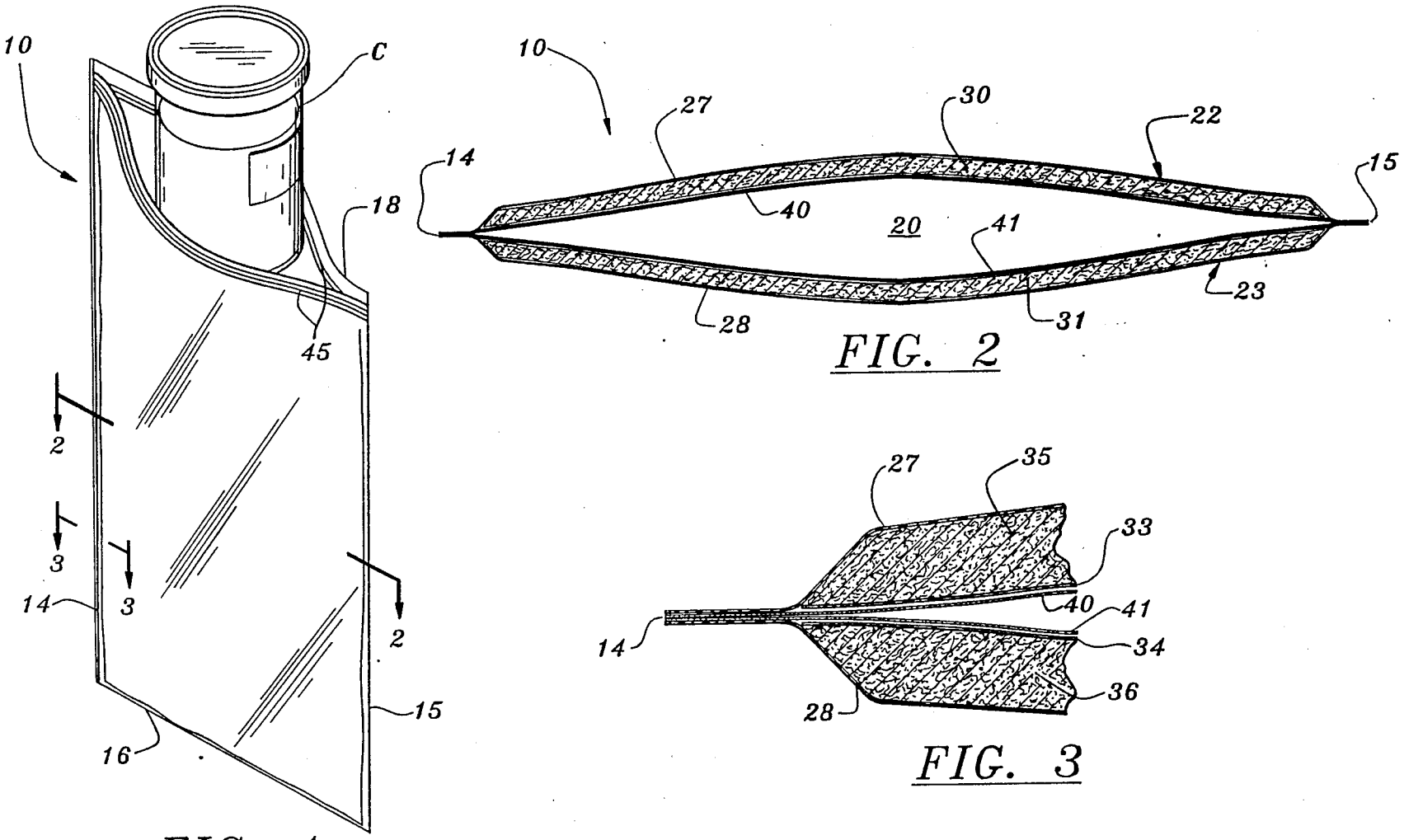
FIG. 1 is a perspective view of a shipping bag embodying the features of the present invention.
FIG. 2 is an enlarged sectional view taken substantially along line 2—2 of FIG. 1.
FIG. 3 is an enlarged fragmentary, sectional view taken substantially along the line 3—3 of FIG. 1.
Figure 4:
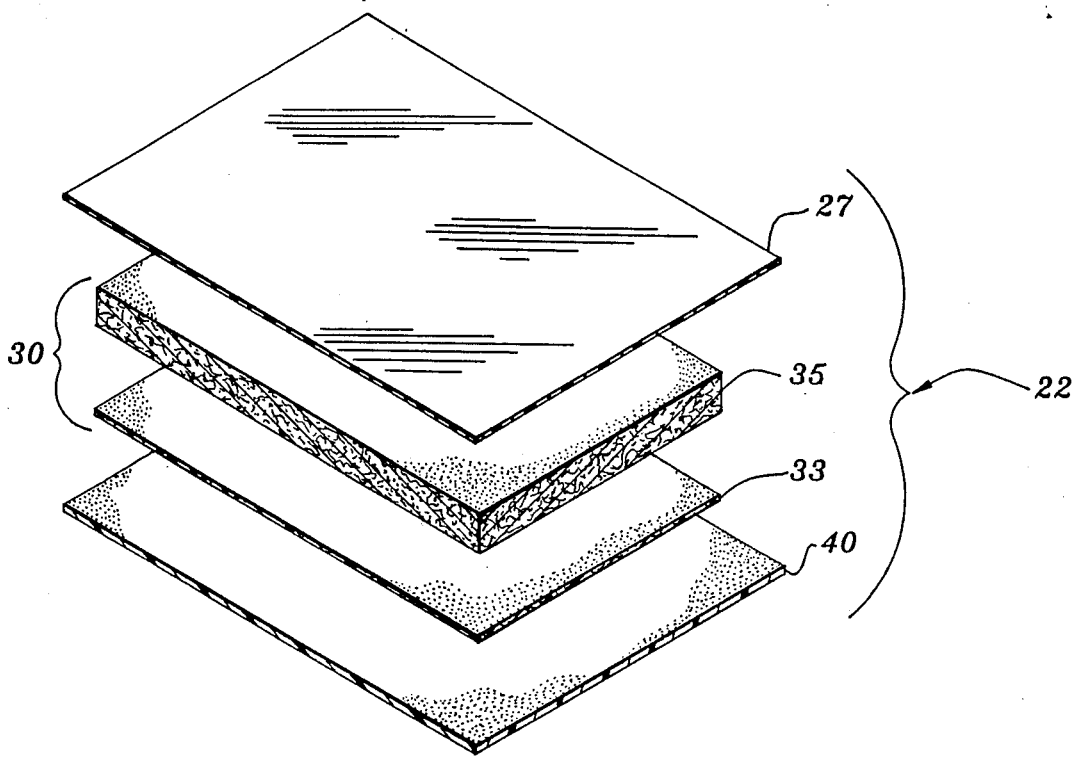
FIG. 4 is a fragmentary exploded perspective view of one wall of the shipping bag to particularly illustrate the liquid absorbent and retention qualities of the bag.

Referring now more particularly to the drawings, FIGS. 1–4 illustrate the preferred embodiment of a shipping bag 10 incorporating the features of the present invention. The shipping bag 10 is generally rectangular in shape and is closed at the opposed side edges 14 and 15 and at a bottom end 16. The bag 10 may be open at the top end 18 to receive materials such as a container C into an open inner space 20 (FIG. 2).

The shipping bag 10 comprises opposed walls 22 and 23 which are sealedly connected together along opposed edges 14 and 15 and end 16. Opposed walls 22 and 23 comprise fist and second outer panels 27 and 28 which are formed of a liquid impervious material and which define a liquid impervious body portion. A polyolefin film, such as polyethylene, is the preferred material for the outer panels 27 and 28, but other fluid impervious films may be used.

Opposed walls 22 and 23 further include an inner liner defined by absorbent pads 30 and 31 and first and second inner panels 40 and 41. The absorbent pads are positioned along the inside of the outer panels 27 and 28 to absorb and retain any free liquid within the bag and the first and second inner panels 40 and 41 are positioned on the opposite sides of the absorbent pads 30 and 31 from the outer panels 27 and 28 and extend parallel thereto. The absorbent pads are made of hydrophilic material, such as defiberized wood pulp (also known as wood fluff), synthetic pulp such as rayon or cotton or other suitable materials. The thickness of the absorbent pad may be varied as desired depending on the amount of absorbency required, but typically such thickness may be between 1/16 to ¾ of an inch. In a preferred embodiment as illustrated herein, the pads 30 and 31 comprise a layer of tissue paper wadding 33 and 34 and a layer of wood fluff 35 and 36. The layer of wood fluff is compressed into a bat in the manner of a nonwoven fabric. The paper wadding may be produced in any conventional manner, such as on a Fourdrinier paper machine, and may, if desired, be creped for added body. The wadding typically has a texture similar to household facial tissue and has substantially more integrity than does the wood fluff. The multiple layer absorbent pads 30 and 31 have the capacity to absorb and retain many times their weight in liquid.

The inner panels 40 and 41 are fluid permeable and non-absorbent so as to allow easy penetration of a liquid therethrough to the adsorbent pads 30 and 31. In the preferred embodiment, the fluid permeable inner panels 40 and 41 are comprised of hydrophobic nonwoven material, such as a polypropylene filamentary material. Such material is particularly characterized by the ability to wick liquid through the material without absorbing any of the liquid. The inner panels 40 and 41 extend outwardly between the outer panels 27 and 28 to the opposed side edges 14 and 15 and the bottom end 16 and are sealedly connected thereat to define the open inner space 20 therebetween. The inner panels 40 and 41 are further sealedly connected to the outer panels 27 and 28 on a line spaced a predetermined distance inwardly from the top end 18 to fully enclose the absorbent pads 30 and 31.

Closure means 45 is provided on the first and second outer panels 27 and 28 at their upper ends which extend beyond the inner panels 40 and 41 to close and seal the inner space 20. In the preferred embodiment, the closure means 45 comprises cooperatively interlocking elongate male and female plastic strips of well-known type. Other suitable closures, such as adhesive flaps or other liquid impervious closures, may be suitable.

In use the shipping bag 10 has a sealed container C of a body fluid or other potentially biohazardous liquid inserted into the inner space 20 of the bag 10 through the open end 18. The closure means 45 is closed to seal the upper end of the bag 10 to confine the container C within the inner space 20 between the inner panels 40 and 41.

The shipping bag 10 may also include, as an additional feature, a bacteriastatic agent to neutralize biohazardous liquid. In particular, the absorbent pads 30 and 31 may be impregnated with a bacteriastatic agent such as a chlorine solution or common household chlorine bleach. The bacteriastatic agent neutralizes biohazardous liquids in the event the container C ruptures adding an additional measure of safety for persons handling the bag.

The absorbent pads 30 and 31 serve as shock absorbers or cushioning to protect the container C from bumps or shocks due to handling to reduce the incidence of breakage or rupture of the container C. However, should the container C be broken or ruptured, the liquid therein will be confined within the bag 10 by the liquid impervious outer panels 27 and 28 and the closure means 45. Any such liquid escaping from a broken or ruptured container C will readily be wicked through the hydrophobic inner panels 40 and 41 and into contact with the absorbent pads 30 and 31 which will absorb the liquid therein. The combination of the absorbent pads 30 and 31, the liquid impervious outer panels 27 and 28, and the non-absorbent inner panels 40 and 41 serve to contain the potentially biohazardous liquid within the absorbent pads 30 and 31 and out of contact with persons handling the shipping bag 10 and with outer packages.

In the drawings and specification there has been set forth a preferred embodiment of the invention, and although specific terms are employed, they are used in a generic and descriptive sense only and not for purposes of limitation.

That which is claimed is:

1. A shipping bag for containers of potentially biohazardous liquids characterized by the ability to absorb such liquid upon rupture of the container and to protect persons handling the bag from contact with such liquid, said bag comprising:

(a) first and second outer panels formed of liquid impervious material connected along opposed side edges and one end to define an open top liquid impervious body portion;

(b) liquid absorbing means confined within said body portion and comprising a pair of absorbent pads arranged adjacent each of said first and second outer panels;

(c) first and second inner panels formed of liquid permeable sheet material made of hydrophobic filaments, wherein said inner panels are confined within said body portion and disposed parallel to said first and second outer panels and respectively connected therewith along said opposed side edges and opposite ends to define an open inner space in communication with said open top and separating said liquid absorbing means from said inner space; and (d) closure means at said open top to sealingly close said inner space and retain any liquids within said body portion to protect persons handling the shipping bag from contact with potentially biohazardous liquid.

2. The shipping bag according to claim 1 wherein said first and second outer panels are comprised of a polyolefin film.

3. The shipping bag according to claim 2 wherein said polyolefin film is a polyethylene film.

4. The shipping bag according to claim 1, wherein said first and second inner panels are comprised of a nonwoven fluid permeable sheet of polypropylene filaments characterized by the ability to wick liquids through the sheet without absorbing any fluid.

5. The shipping bag according to claim 1 wherein said absorbent pads are comprised of a plurality of layers of absorbent material.

6. The shipping bag according to claim 5 wherein said absorbent pads are comprised of a layer of paper wadding and a layer of defiberized wood pulp.

7. The shipping bag according to claim 1 wherein said absorbent pad is impregnated with a bacteriastatic agent.

8. The shipping bag according to claim 1 wherein said bacteriastatic agent comprises chlorine bleach.

9. A shipping bag for containers of potentially biohazardous liquids characterized by the ability to absorb such liquid upon rupture of the containers and to protect persons handling the bag from contact with such liquid, said bag comprising:

(a) first and second outer panels formed of liquid impervious polyethylene film connected along opposed side edges and one end to define an open top liquid impervious body portion;

(b) liquid absorbing means confined within said body portion and comprising a pair of absorbent pads arranged adjacent each of said first and second outer panels, each pad being comprised of a layer of paper wadding and a layer of defiberized wood pulp;

(c) first and second inner panels formed of liquid permeable hydrophobic sheet material made of nonwoven polypropylene filaments, wherein said inner panels are confined within said body portion and disposed parallel to said first and second outer panels and respectively connected therewith along said opposed side edges and opposite ends to define an open inner space in communication with said open top and separating said liquid absorbing means from said inner space, and wherein the nonwoven material is characterized by the ability to wick liquids therethrough without absorbing any fluid; and (d) closure means at said open top to sealingly close said inner space and retain any liquids within said body portion to protect persons handling the shipping bag from contact with potentially biohazardous liquid.

10. The shipping bag according to claim 9 wherein said panels are connected together by heat sealing.

11. The shipping bag according to claim 9 wherein said absorbent pad is impregnated with a bacteriastatic agent.

* * * * *